US006881162B2

(12) United States Patent
Nye et al.

(10) Patent No.: US 6,881,162 B2
(45) Date of Patent: Apr. 19, 2005

(54) BASKETBALL GOAL-SYSTEM THAT IS CAPABLE OF BEING ASSEMBLED WITHOUT TOOLS

(75) Inventors: S. Curtis Nye, Clinton, UT (US); David C. Winter, Layton, UT (US)

(73) Assignee: Lifetime Products, Inc., Clearfield, UT (US)

( * ) Notice: Subject to any disclaimer, the term of this patent is extended or adjusted under 35 U.S.C. 154(b) by 11 days.

(21) Appl. No.: 10/358,317

(22) Filed: Feb. 3, 2003

(65) Prior Publication Data

US 2004/0176195 A1 Sep. 9, 2004

Related U.S. Application Data

(60) Provisional application No. 60/354,460, filed on Feb. 4, 2002.

(51) Int. Cl.[7] ..... A63B 63/08
(52) U.S. Cl. ..... 473/481
(58) Field of Search ..... 473/481, 479, 473/483, 485, 476, 472, 484, 486, 488, 447

(56) References Cited

U.S. PATENT DOCUMENTS 4,145,044 A 3/1979 Wilson et al.
4,762,319 A 8/1988 Krumholz
5,248,140 A * 9/1993 Mower et al. ..... 473/484
5,259,612 A 11/1993 Matherne et al.
5,377,976 A * 1/1995 Matherne et al. ..... 473/483
5,433,432 A 7/1995 Adler
5,507,484 A * 4/1996 van Nimwegen et al. .. 473/481
5,527,185 A 6/1996 Davis
5,816,955 A * 10/1998 Nordgran et al. ..... 473/486
6,042,297 A 3/2000 Lah
6,296,583 B1 * 10/2001 Tatar, Sr. ..... 473/486

* cited by examiner

*Primary Examiner*—Sebastiano Passaniti
*Assistant Examiner*—M. Chambers
(74) *Attorney, Agent, or Firm*—Workman Nydegger

(57) ABSTRACT

A basketball goal system that is capable of being assembled without tools is disclosed. The basketball goal system may include a support member, a rim, a bracket, a brace and a backboard. A support pin is sized and configured to be inserted through a first set of openings in the support member, a first set of openings in the bracket and a first set of openings in the brace to connect the bracket and brace to the support member. The backboard is attached to the support member by inserting at least a portion of the first support pin into the first groove in the backboard and inserting at least a portion of the brace into a brace groove. The basketball goal system may also include a second set of openings in the support member, a second set of openings in the bracket, and a second set of openings in the brace. A second support pin is sized and configured to be inserted through the second set of openings in the support member, bracket and brace to connect the bracket and brace to the support member.

28 Claims, 4 Drawing Sheets

BASKETBALL GOAL-SYSTEM THAT IS CAPABLE OF BEING ASSEMBLED WITHOUT TOOLS

CROSS-REFERENCE TO RELATED APPLICATIONS

This patent application claims priority to and the benefit of U.S. Provisional patent application Ser. No. 60/354,460, entitled Basketball Goal System Having A Tool-Less Assembly, filed on Feb. 4, 2002, which is hereby incorporated by reference in its entirety.

BACKGROUND OF THE INVENTION

1. Field of the Invention

The present invention generally relates to a basketball goal system and, more specifically, to a basketball goal system that is capable of being assembled without tools.

2. Description of Related Art

As the game of basketball continues to increase in popularity, a large number of people have purchased basketball systems for use at their homes. Such basketball systems typically include a support pole, which is held in a fixed position while playing the game of basketball, and goal assembly that is attached to the upper portion of the support pole. The goal assembly, which is suspended a given distance above a playing surface, includes a basketball backboard and goal or hoop.

Conventional basketball systems designed for use at home often include a basketball backboard with a metal frame that is attached to the support pole by a support structure that includes four or more elongated arms. The ends of the elongated arms are typically connected to the basketball backboard frame and the support pole by screws or bolts. In addition, the backboard is generally attached to the metal support frame by one or more screws or bolts. The connection of the elongated arms to the basketball backboard and the support pole often requires a significant amount of time and labor. In particular, the connection and fastening of the screws or bolts to the backboard and support structure often requires a significant amount of time and labor whether the manufacturer or consumer is assembly the basketball system.

Conventional basketball systems may also use two or more bolts or screws to attach the rim or hoop to the basketball backboard. Alternatively, conventional basketball systems may use two or more bolts or screws to attach the rim to the support structure. Thus, conventional basketball systems frequently require a number of screws and/or bolts to connect the rim and backboard to the support pole.

In order to attach the rim and backboard of conventional basketball systems to the support pole, various tools such as wrenches, pliers, screwdrivers, sockets, etc. may be used. Disadvantageously, the use of tools increases the time required to assemble the basketball system. In addition, if the consumer is assembling the basketball system, he or she may not have the appropriate tools and it may require an excessive amount of time to assemble the basketball system. Thus, the consumer may not purchase the product or the consumer may require assistance in assembling the basketball system. Further, because the assembly of conventional basketball systems may require connecting a number of different components, the assembly instructions may be complicated and difficult to follow. Accordingly, this may also discourage a consumer from purchasing the basketball system.

Because conventional basketball systems require a number of bolts, screws and other types of fasteners, the systems are time consuming to manufacture and assemble. In addition, if the basketball system is shipped unassembled, then the packaging must be carefully checked to insure that all the components and fasteners are included. Unfortunately, because one or more of the fasteners may be lost during the shipping process or by the consumer, extra fasteners are often included which further increases the cost of the basketball system. On the other hand, if the fasteners are not included with the basketball system or the consumer losses one or more of the fasteners, then the consumer has to obtain the correct fasteners, which may be very difficult and time consuming for the consumer.

Conventional basketball systems, which are typically placed outdoors where they are subjected to harsh weather conditions such as wind and rain, require a secure connection of the basketball backboard to the support structure and the support structure to the support pole. In order to create this secure connection, the various screws and bolts are often very tightly connected by using one or more tools. Disadvantageously, this makes conventional basketball systems very difficult to disassemble if the basketball system needs to be moved or repositioned. In addition, if the fasteners or other portions of the basketball system have begun to rust or otherwise deteriorate, then the basketball system may be difficult if not impossible to disassemble.

Basketball backboards for use with conventional basketball systems have previously been constructed from solid materials such as wood. Disadvantageously, wooden basketball backboards deteriorate over time, especially when used in outdoor environments because the backboards are constantly exposed to harsh weather environments such as rain and snow. Basketball backboards for home basketball systems have also been constructed from injection molded plastic. Injection molded plastic backboards, however, are relatively flexible and that causes poor rebounding characteristics. That is, when the basketball strikes the injection molded backboard, the backboard will flex and the basketball will not bounce off of the backboard in a consistent manner. In order to overcome this problem, injection molded plastic backboards typically include strengthening ribs and other complex structures in an attempt to make the backboards more rigid. These strengthening ribs and other structures, however, increase the weight and cost of the backboard. Additionally, known basketball backboards may be constructed using a structural foam material with an internal cellular structure and a hard external shell. This type of backboard requires a multiple step manufacturing process, which increases the time and cost to manufacture the backboard.

BRIEF SUMMARY OF THE INVENTION

A need therefore exists for a basketball goal system that eliminates the above-described disadvantages and problems.

One aspect of the basketball goal system is the backboard, rim and/or support pole can be connected without requiring the use of tools. Advantageously, because tools are not required to construct the basketball goal system, the backboard, rim and/or support pole can be quickly and easily connected.

Another aspect of the basketball goal system is the backboard, rim and/or support pole can be connected without using fasteners such as bolts or screws. Significantly, this allows the backboard, rim and/or support pole to be quickly and easily connected. In addition, this may decrease assembly time and costs because fasteners do not have to be provided or connected to the basketball goal system.

Advantageously, because the basketball goal system is capable of being assembled without tools, that allows the system to be quickly and easily assembled and disassembled. In addition, because the basketball goal system does not require the use of fasteners to connect the backboard, rim and/or support pole, that also allows the system to be quickly and easily assembled and disassembled.

Yet another aspect of the basketball goal system is the backboard is desirably constructed from blow-molded plastic with a generally hollow interior portion. Significantly, the lightweight basketball backboard can be easily transported, which decreases shipping costs. The lightweight basketball backboard can also be easily moved and stored. Additionally, the lightweight basketball backboard allows a basketball goal system to be easily constructed and assembled. Further, because the basketball backboard is lightweight, it does not require a large support structure to support the backboard above the playing surface.

Another aspect of the basketball goal system is the backboard may include one or more depressions, "tack-offs" or "kiss-offs," may be formed in the frame. The depressions, which extend from one surface towards another surface, are desirably sized and configured to increase the strength and/or rigidity of the frame. Preferably, the depressions extend from one surface and contact or engage an opposing surface, but the depressions do not have to contact or engage the opposing surface. The depressions are desirably formed in the back or rear surface of the basketball backboard so that the depressions are generally not visible while playing the game of basketball. The depressions, however, may also be formed in the front surface or other surfaces of the basketball backboard. If the depressions are formed in the front surface of the backboard, these depressions may be covered in whole or in part by the backboard or rebound member. In addition, one or more depressions may be formed in the rear surface of the backboard and one or more depressions may be formed in the front surface of the backboard, and these opposing depressions may be generally aligned. At least a portion of these opposing depressions preferably contact or engage each other, but the opposing depressions do not touch or engage. Finally, a portion of the basketball backboard may include one or more depressions on one surface and one or more depressions in an opposing surface.

Advantageously, the blow-molded plastic basketball backboard is relatively strong because it preferably includes two or more opposing walls or surfaces that are separated by a given distance. The opposing walls help create a high-strength, rigid basketball backboard. Because the interior portion of the backboard between the opposing walls is generally hollow, that creates a lightweight backboard. Significantly, the strong and sturdy basketball backboard can withstand repeated impacts with a basketball or other similar objects. Further, the strong and rigid backboard allows a basketball system with good rebounding characteristics to be constructed.

Significantly, the basketball backboard can be quickly and easily constructed because it is preferably constructed using a blow-molded plastic process. Advantageously, the blow-molding process allows the double walls and any suitable number of depressions to be quickly and easily formed. As discussed above, the double walls and depressions allow a strong and sturdy backboard to be constructed. These and other features also allow the basketball backboard to be constructed with relatively thin plastic walls and that reduces the amount of materials used to construct the backboard. This saves manufacturing costs and reduces the amount of resources required to construct the backboard. The thin plastic walls also allow the backboard to be cooled more quickly during the manufacturing process, and that saves time and further decreases costs.

Yet another aspect of the basketball backboard is it can be constructed in any desired configuration, shape, size and design depending, for example, upon the intended use and/or configuration of the backboard. Significantly, if the basketball backboard is a constructed from blow-molded plastic, it can easily be formed into any desired size, configuration, and color. Further, basketball backboards constructed from blow-molded plastic are durable, weather resistant and generally temperature insensitive. The blow-molded plastic basketball backboards, in contrast to conventional metal frames, do not corrode, rust or otherwise deteriorate over time.

These and other aspects, features and advantages of the present invention will become more fully apparent from the following detailed description of preferred embodiments and appended claims.

BRIEF DESCRIPTION OF THE DRAWINGS

The appended drawings contain figures of preferred embodiments to further clarify the above and other aspects, advantages and features of the present invention. It will be appreciated that these drawings depict only preferred embodiments of the invention and are not intended to limits its scope. The invention will be described and explained with additional specificity and detail through the use of the accompanying drawings in which.

DETAILED DESCRIPTION OF THE PREFERRED EMBODIMENTS

The present invention is directed towards a basketball goal system. The principles of the present invention, however, are not limited to a basketball goal system. It will be understood that, in light of the present disclosure, the basketball goal system disclosed herein can be successfully used in connection with other types of basketball and sporting equipment.

Additionally, to assist in the description of the basketball goal system, words such as top, bottom, front, rear, right and left are used to describe the accompanying figures. It will be appreciated, however, that the basketball goal system can be located in a variety of desired positions—including various angles, sideways and even upside down. A detailed description of the basketball goal system now follows.

Figure 1:
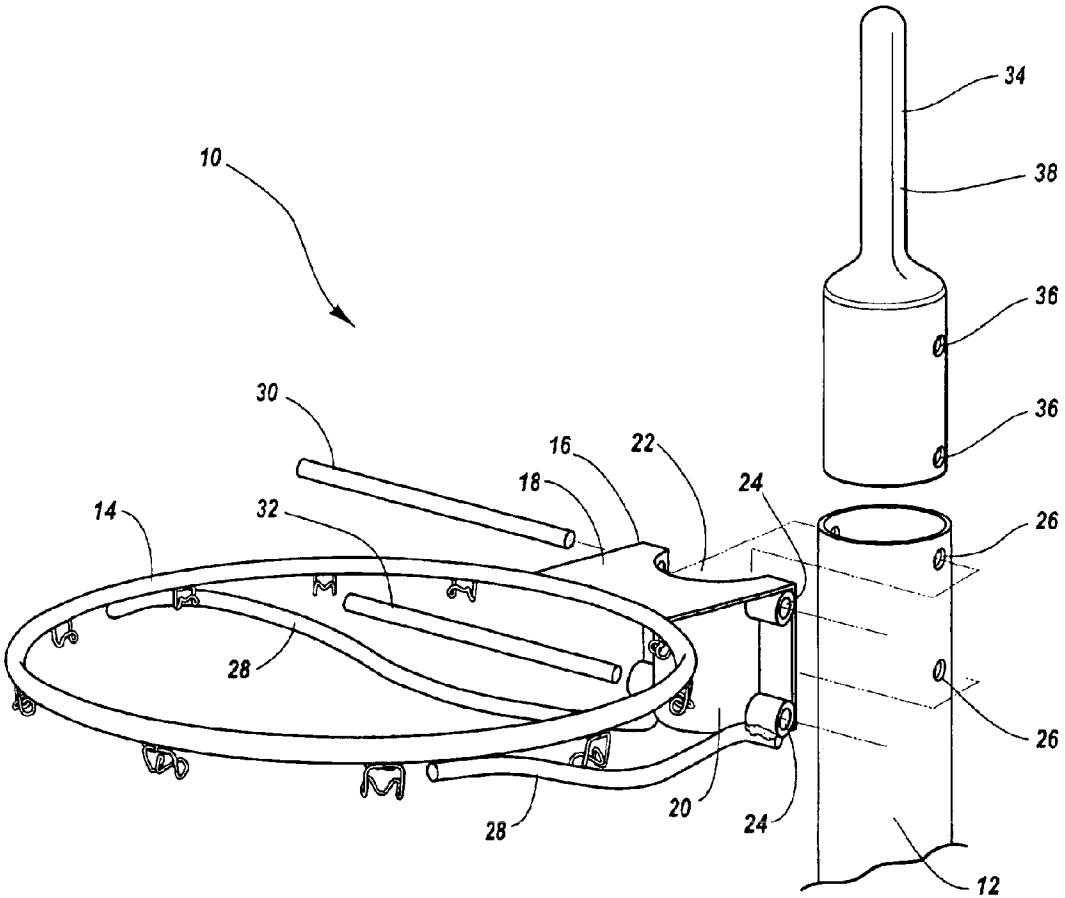
FIG. 1 is an exploded perspective view of a portion of a basketball goal system in accordance with a preferred embodiment of the invention, illustrating a portion of the support pole, rim, bracket and support brace.

As seen in FIG. 1, the basketball goal system 10 includes a support pole 12 and a rim or hoop 14. The support pole 12, as shown in the accompanying drawings, is preferably a hollow, cylindrical tube with a generally planar upper end. The lower end of the support pole 12 can be attached to the ground as part of an in-ground basketball system, attached to a movable base as part of a transportable basketball system, or attached to any other desirable type of support member or surface. The support pole 12 is desirably constructed from metal, such as steel, or other relatively high-strength material. It will be appreciated, however, that the support pole 12 can be constructed from other suitable materials and it can have other shapes and configurations depending, for example, upon the type of material used to construct the support pole. For example, the support pole 12 could be constructed from a solid member and the support pole could have other configurations such as triangular, rectangular, square, oval, oblong and the like.

As shown in FIG. 1, the upper end of the support pole 12 is preferably generally aligned with the rim 14. That is, the upper end of the support pole 12 and the upper surface of the rim 14 are located in generally the same plane. It will be understood, however, that the upper end of the support pole 12 and rim 14 do not have to be generally aligned or in the same plane. In addition, the upper end of the support pole 12 can have any desired configuration depending, for example, upon the intended use of the basketball goal system 10.

The rim 14 is attached to the support pole 12 by a bracket 16 which includes a rim plate 18 and a mounting portion 20. The rim plate 18 includes a generally planar upper surface that is generally aligned with the upper surface of the rim 14. The rim plate 18 is preferably size and configured to space the rim 14 the proper distance from the backboard, which is described in more detail below. The bracket 16 and rim plate 18 are preferably constructed from metal and the rim plate is preferably welded to a portion of the rim 14, but the rim plate and rim may be constructed from various materials and the rim plate may be connected to the rim by any suitable manner.

The mounting portion 20 is preferably sized and configured to allow the bracket 16 to be quickly and easily connected to the support pole 12. In particular, the mounting portion 20 preferably includes a rounded surface with a radius of curvature that is generally the same or slightly larger than the radius of curvature of the outer surface of the support pole 12. Thus, the mounting portion 20 of the bracket 16 is sized and configured to receive, contact and/or engage a portion of the support pole 12. Of course, if the support pole 12 has a different configuration, then the mounting portion 20 of the bracket 16 may also have a different configuration to allow the bracket 16 to be connected to the support pole 12. In addition, the rim plate 18 of the bracket 16 preferably includes a cutout 22 that allows a portion of the support pole 12 to extend through the cutout. The cutout 22, however, is not required and the rim plate 18, may extend over or cover all or a portion of the upper surface of the support pole 12.

As best seen in FIG. 1, four sleeves, bushings, or receiving portions 24 are preferably attached to or integrally formed as part of the bracket 16. The sleeves 24 are aligned with corresponding openings in the bracket 16 and the sleeves are preferably arranged into an upper pair and a lower pair that are disposed proximate the mounting portion 20 of the bracket. The sleeves 24 are preferably tubular members that are securely attached to the bracket 16 by welding or other suitable means. The sleeves 24 may also be integrally formed as part of the bracket 16. For example, a portion of the bracket 16 may be bent into circular eyelet-type structures to form the sleeves 24. The sleeves 24, however, are not required and the bracket 16 may simply include one or more openings.

The bracket 16 may also include two support members 28 in order to more securely attach the rim 14 to the bracket. In particular, one end of each support member 28 is attached to a lower portion of the bracket 16 and/or a lower sleeve 24 disposed on each side of the bracket. The other end of the support member 28 is securely attached to the rim 14. The support members 28 are preferably welded to the rim 14 and bracket 16, but the support members can be attached by any suitable manner. Advantageously, the support members 28 help prevent the rim 14 from undesirably bending or deforming when playing the game of basketball. For example, when a player dunks a basketball, the player may strike the rim 14 with the basketball and/or a portion of his or her body. The player may also hang on the rim 14 or inadvertently grab the rim during the game or practice. These actions may place a large force and stress on the rim 14 and the support members 28 help transfer the force from the rim to the bracket 16. Because the bracket 16 is preferably securely attached to the support pole 12, the forces can then be transferred to the support pole.

Figure 2:
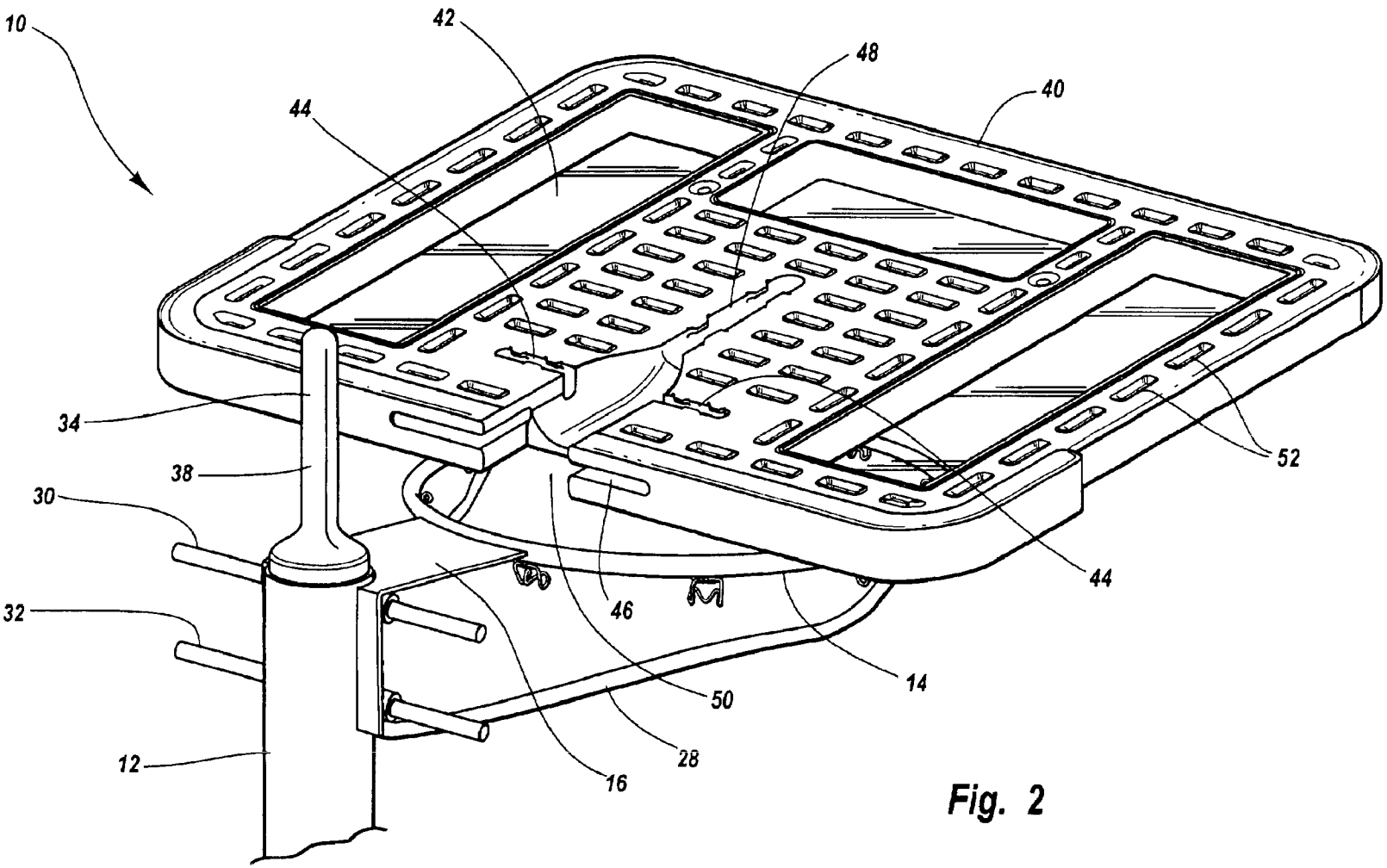
FIG. 2 is a perspective view of a portion of the basketball goal system shown in FIG. 1, illustrating a backboard positioned proximate the support pole and rim.

The sleeves 24 are preferably aligned with corresponding openings 26 in the support pole 12. In particular, the openings 26 are preferably positioned such that when the mounting portion 20 of the bracket contacts the support pole 12, the openings in the support pole are aligned with the sleeves 24. This allows an upper support pin 30 to be inserted through the upper pair of sleeves 24 and corresponding openings 26 in the support pole 12, and a lower support pin 32 to be inserted through the lower pair of sleeves and corresponding openings in the support pole. As best seen in FIG. 2, the pins 30, 32 preferably extend through both the bracket 16 and the support pole 12. The pins 30, 32 may be held in a generally fixed position by a friction or interference fit, or by other suitable means such as a detent mechanism, lock, tab, etc. Desirably, the pins 30, 32 are preferably held in a generally fixed position when the pins are inserted through the sleeves 24 and openings 26, but the pins are also readily removable to allow the basketball goal system 10 to be disassembled. The pins 30, 32, however, may also be permanently attached to the bracket 16 and support pole 12.

As shown in the accompanying figures, the pins 30, 32, sleeves 24 and openings 26 are preferably circular to allow the basketball goal system 10 to be easily manufactured and assembled. It will be appreciated that the pins 30, 32, sleeves 24 and/or openings 26 may have any desirable shape and configuration depending, for example, depending upon the intended use of the basketball goal system 10. For instance, the pins 30, 32, sleeves 24 and/or openings 26 may have a generally triangular, square, rectangle, oval, oblong or other configuration.

Advantageously, the pins 30, 32 and corresponding sleeves 24 and openings 26 allow the bracket 16 to be securely attached to the support pole 12 without requiring the use of tools. It will be appreciated that one or more tools may be used to insert the pins 30, 32 if desired. Tools may also be used to disconnect the bracket 16 from the support pole 12 if necessary. Significantly, because tools are not required to attach the rim 14 to the support pole 12, the basketball goal system may be quickly manufactured and a consumer may be able to easily assemble the system.

Although not shown in the accompanying figures, the support pole 12 may include multiple pairs of generally aligned openings 26 in order to allow the bracket 16 to be attached in various portions of the support pole. This may allow, for example, the height of the rim 14 to be adjusted relative to the playing surface. On the other hand, the bracket 16 may be permanently or integrally attached to the support pole 12.

As shown in FIG. 1, a brace 34 may be inserted into the upper end of the support pole 12. The brace 34 includes a pair of openings 36 that are preferably aligned with the openings 26 in the support pole 12 when the brace is positioned within the upper end of the support pole 12. Desirably, when the pins 30, 32 are inserted through the sleeves 24 and the openings 26 in the support pole 12, the pins also pass through the openings 36 in the brace 34 to hold the brace in a generally fixed position. The brace 34 preferably has a base with a generally circular configuration with an outside diameter that is slightly smaller than the inside diameter of the support pole 12, but the brace could have any suitable size and configuration depending, for example, upon the size and configuration of the support pole.

The basketball goal system 10 may also include an alignment mechanism for correctly positioning the brace 34 within the support pole 12. For example, the support pole 12 could include an inwardly extending tab or stop that allows the brace 34 to be inserted a desired distance into the upper end of the support pole. Additionally, a slot, detent, protrusion or other similar type of device may align the rotational position of the brace 34 relative to the support pole 12 so that the openings 26 in the support pole are aligned with the openings 36 in the brace. Thus, one or more alignment mechanisms may be used to vertically and/or rotationally align the brace 34 relative to the support pole 12. While these different alignment mechanisms may assist in attaching the brace 34 to the support pole 12, the use of the alignment mechanisms is not required.

The brace 34 includes an upwardly extending support member 38 that, as discussed below, is used to attach the backboard to the support pole 12. The upwardly extending support member 38 preferably has a generally circular configuration with a diameter that is smaller that the base, but the upwardly extending support member could be larger than the base. The brace 34 is preferably constructed from a relatively strong and rigid material, such as metal, to allow the backboard to be securely connected to the support pole. One skilled in the art will appreciate that the brace 34 can have other suitable sizes and configurations depending, for example, upon the size and configuration of the support pole 12 or the intended use of the basketball goal system 10.

As shown in FIG. 2, a backboard 40 desirably forms part of the basketball goal system 10. The backboard 40 is preferably constructed from a lightweight material, such as plastic. Desirably, the backboard 40 is constructed from blow-molded plastic to create a strong, lightweight and durable backboard. In greater detail, the backboard 40 is preferably constructed using a blow-molded plastic process, and the backboard includes two opposing walls or surfaces that are separated by a given distance in order to create a strong and sturdy structure. In addition, the interior portion of the blow-molded backboard 40 is preferably generally hollow. Advantageously, this creates a backboard 40 that is lightweight, strong and rigid, which allows the backboard to withstand repeated impacts with a basketball or other similar objects.

The backboard 40 is preferably constructed from blow-molded plastic because it can easily be formed into any desired size and configuration. The backboard 40 is also desirably constructed from blow-molded plastic because it is durable, weather resistant and generally temperature insensitive. Advantageously, the backboard 40 constructed from blow-molded plastic generally does not corrode, rust or otherwise deteriorate over time.

The backboard 40 is preferably constructed from lightweight, blow-molded plastic because weight reduction of the basketball goal system 10 is highly desirable. For example, many home basketball systems are marketed directly to consumers in retail stores. Thus, the purchaser may be required to bring the basketball system to a register to be purchased, load the system in a vehicle, and assemble the system at home. If the backboard 40 is heavy, then the weight of the basketball goal system 10 and the overall weight of the entire basketball system is increased. A consumer may be reluctant to purchase and assemble a basketball system that is too heavy.

Advantageously, constructing the backboard 40 from lightweight, blow-molded plastic decreases shipping costs, whether shipping the system from the manufacturer to a retailer or consumer. In addition, the lightweight backboard 40 simplifies the assembly of the basketball goal system 10 because the lighter weight backboard is easier to manipulate and control during the assembly process. Advantageously, because the backboard 40 is lightweight, the support 12 pole and/or other support structures do not have to support a heavy backboard. This allows the support pole 12, bracket 16, and/or brace 34 to be constructed from lighter weight materials.

The backboard 40 may be constructed entirely from blow-molded plastic or it may include one or more openings 42 that are covered by a rebound member such as an acrylic sheet. The rebound member may be attached to the backboard 40 in various suitable ways including those disclosed in Assignee's copending U.S. patent application Ser. No. 09/228,325, entitled System and Method for Bonding an Acrylic Surface to a Frame, filed on Jan. 11, 1999, which is hereby incorporated by reference in its entirety.

The backboard 40 preferably includes an upper groove 44, a lower groove 46, a brace groove 48 and a cutout 50. The upper groove 44 is sized and configured to receive the upper support pin 30, the lower groove 46 is sized and configured to receive the lower support pin 32, and the brace groove 48 is sized and configured to receive the brace 34. Preferably, at least a portion of the upper support pin 30, lower support pin 32 and/or brace 34 are snap-fit or held within the upper groove 44, lower groove 46 and brace groove 48, respectively, by a friction or interference fit. In particular, the upper groove 44, lower groove 46 and brace groove 48 preferably include an opening that is slightly smaller then the size of the upper support pin 30, lower support pin 32 and brace 34, respectively. When the upper support pin 30, lower support pin 32 and brace 34 are inserted into the upper groove 44, lower groove 46 and brace groove 48, the opening preferably deforms or distorts slightly to allow the pins and brace to be inserted into the respective grooves. The openings to the upper groove 44, lower groove 46 and brace groove 48 then resiliently return to the original configuration to hold the pins and brace within the grooves.

One skilled in the art will appreciate that the upper support pin 30, lower support pin 32 and brace 34 can be attached to the upper groove 44, lower groove 46 and brace groove 48 in other suitable ways, for example, by using movable members, adhesives, fasteners, and the like. For example, various structures can be molded into the rear surface of the backboard 40 that fold or move over at least a portion of the grooves 44, 46, and 48 to prevent detachment of the pins 30, 32 and/or brace 34. For example, a plastic flap could be molded into the back of the backboard 40 on one side of a groove and a slot could be provided on the other side of groove to allow the flap to be inserted into the slot to help prevent the pin or brace from disengaging from the groove.

Additionally, a locking mechanism may be placed in or near the groove in order to lock the pin or brace to the backboard 40. For example, a snap fit type mechanism may be employed to lock the pin or brace into the groove. In addition, a pin type fastener could be used to prevent the pin or brace from being inadvertently removed from the groove. Further, a retaining member that is slidably attached to the rear of the backboard 40 may be used to hold the pin or brace within the groove. Thus, other structures may be used to retain the pin and/or brace within the respective grooves.

The lower groove 46 is preferably located in a bottom surface of the backboard 40, which advantageously allows the lower support pin 32 to be inserted into the lower groove first. Thus, the lower support pin 32 can help support the backboard 40 when it is being attached to the upper support pin 30 and brace 34. The upper groove 44 is preferably sized and configured to receive the upper support pin 30 when the lower support pin 32 is inserted into the lower groove. Desirably, the upper and lower support pins 30, 32 may help prevent the backboard 40 from pivoting or rotating about the support pole 14. The brace groove 48 is preferably sized and configured to receive the brace 34 when the lower support pin 32 is inserted into the lower groove 46. The brace 34 is preferably sized and configured to help prevent the backboard 40 from deflecting along a vertical axis during a basketball game or practice.

The backboard 40 also includes a cutout 50 which is preferably formed in the lower portion of the backboard. The cutout 50 is sized and configured to allow at least a portion of the bracket 16 to pass through the cutout. In particular, the cutout 50 desirably allows the rim plate 18 of the bracket 16 to extend through the cutout in the backboard. The size and configuration of the cutout 50, of course, may be dependent upon the configuration of the bracket 16 and/or support pole 12. Additionally, in some configurations of the basketball goal system 10, the cutout 50 may not be required.

The backboard 40 is preferably constructed from blow-molded plastic because it allows multiple features to be formed in the backboard. For example, the first groove 44, second groove 46, brace groove 48 and cutout 50 can be formed during the blow-molding process. Forming these and other features during the blow-molding process can save time and manufacturing costs. In addition, these features are preferably integrally formed in the backboard 40 and simultaneously created during the blow-molding process. Because these features may be simultaneously formed during the blow-molding process, this may save costs because the overall manufacturing cost of a product generally increases with each additional manufacturing step.

The backboard 40 is also preferably constructed as a unitary, one-piece structure. Advantageously, this further decreases manufacturing costs and time because one or more components do not have to be assembled or fastened together. In addition, the one-piece structure allows a strong and sturdy backboard 40 to be manufactured. It will be appreciated that the backboard 40, however, may be constructed by one or more components that are fastened together by any suitable means.

As shown in the accompanying figures, the backboard 40 preferably has a generally rectangular outer periphery or exterior. It will be appreciated, however, that the backboard 40 does not require a generally rectangular configuration. For example, the outer edges of the frame 14 can be curved, rounded, arched, fan-shaped, or have any suitable design and configuration depending, for example, upon the intended use of the frame.

The backboard 40 may also include other features such as the depressions 52 or "tack-offs" shown in FIG. 2. The depressions 52, which extend from one surface towards the other surface, are desirably sized and configured to increase the strength and/or rigidity of the backboard 40. Preferably, the depressions 52 extend from one surface and contact or engage an opposing surface, but the depressions do not have to contact or engage the opposing surface. The depressions 52 are desirably formed in the back or rear surface of the backboard 40 so that the depressions are generally not visible while playing the game of basketball. The depressions 52, however, may also be formed in the front surface of the backboard 40. In addition, one or more depressions 52 may be formed in the rear surface of the frame 14 and one or more depressions may be formed in the front surface of the frame, and these opposing depressions may be aligned. Desirably, at least a portion of these opposing depressions 52 contact or engage each other, but the opposing depressions do not have to touch or engage. One skilled in the art will appreciate that the number, size and location of the depressions 52 may depend upon factors such as the desired strength of the backboard 40. Further, a portion of the backboard 40 may include one or more depressions 52 on one surface and one or more depressions in an opposing surface. For example, the front surface of the backboard 40 may include one or more depressions 52 that are generally hidden by the rebound member and the rear surface of the backboard may also include one or more depressions depending upon the desired characteristics of the basketball goal system 10.

The depressions 52 preferably have generally tapered walls and the ends of the depressions may contact or engage the inner surface of the opposing wall. As discussed above, the ends of the depressions 52 do not have to contact or engage an opposing surface. As shown in the accompanying figures, the depressions 52 preferably have a generally trapezoidal configuration. Advantageously, the trapezoidal configuration provides desirable bearing and torsional characteristics for the basketball goal system 10. For example, the trapezoidal shape may help to prevent the backboard 40 from bending or yielding when a basketball rebounds from the backboard. Other backboards with suitable characteristics that may be used with the basketball goal system 10 are disclosed in Assignee's copending U.S. patent application Ser. No. 10,352,940, entitled Blow Molded Basketball Backboard Frame, filed on Jan. 29, 2003, which is hereby incorporated by reference in its entirety.

Figure 3:
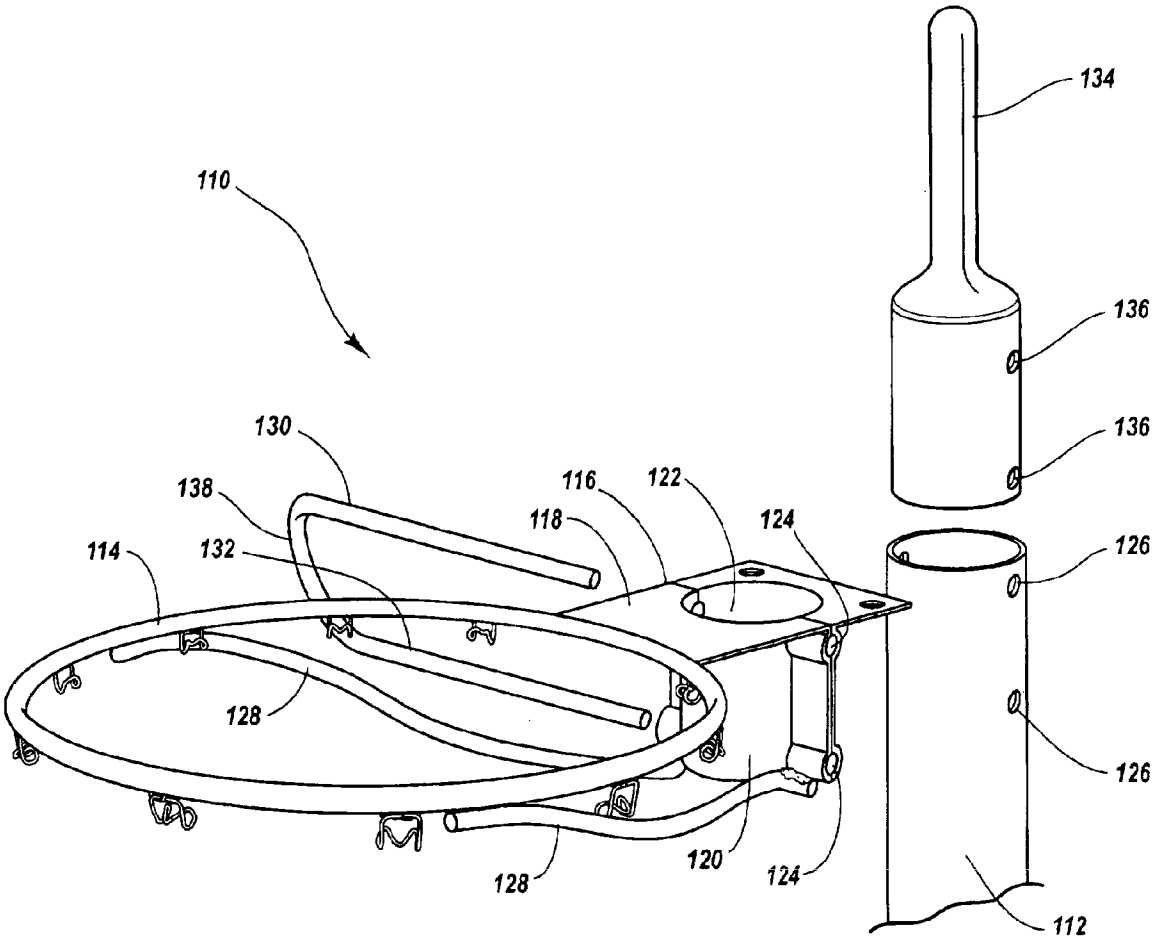
FIG. 3 is an exploded perspective view of a portion of a basketball goal system in accordance with another preferred embodiment of the invention, illustrating a portion of the support pole, rim, bracket and support brace.

As shown in FIG. 3, the basketball goal assembly 110 may have other suitable configurations. For example, the bracket 116 may include a sleeve 120 that is sized and configured to slide around or be connected to the support pole 112. The sleeve 120 preferably has an inner diameter that is slightly larger than or generally equal to the outside diameter of the support pole 112, but it will be understood that the sleeve 120 may have any suitable size and configuration depending, for example, upon the size and configuration of the support pole 112. The bracket 116 may include two or more pieces that are interconnected to form the bracket. For example, the bracket 116 may include a front half and a rear half that are connected by fasteners, adhesives, or the like. Advantageously, this may allow the bracket 116 to be quickly and easily attached to the support pole 112. The bracket 116, however, may also consist of a single component and it could be integrally formed with the support pole 112.

FIG. 3 also illustrates that the upper and lower support pins may consist of a single U-shaped pin 138 with an upper portion 130 and a lower portion 132. The U-shaped pin 138 may allow the basketball goal assembly 110 to be quickly and easily assembled and disassembled. One skilled in the art will understand that the pin 138 can have other configurations and the basketball goal system may be constructed with only a single pin or multiple pins.

Figure 4:
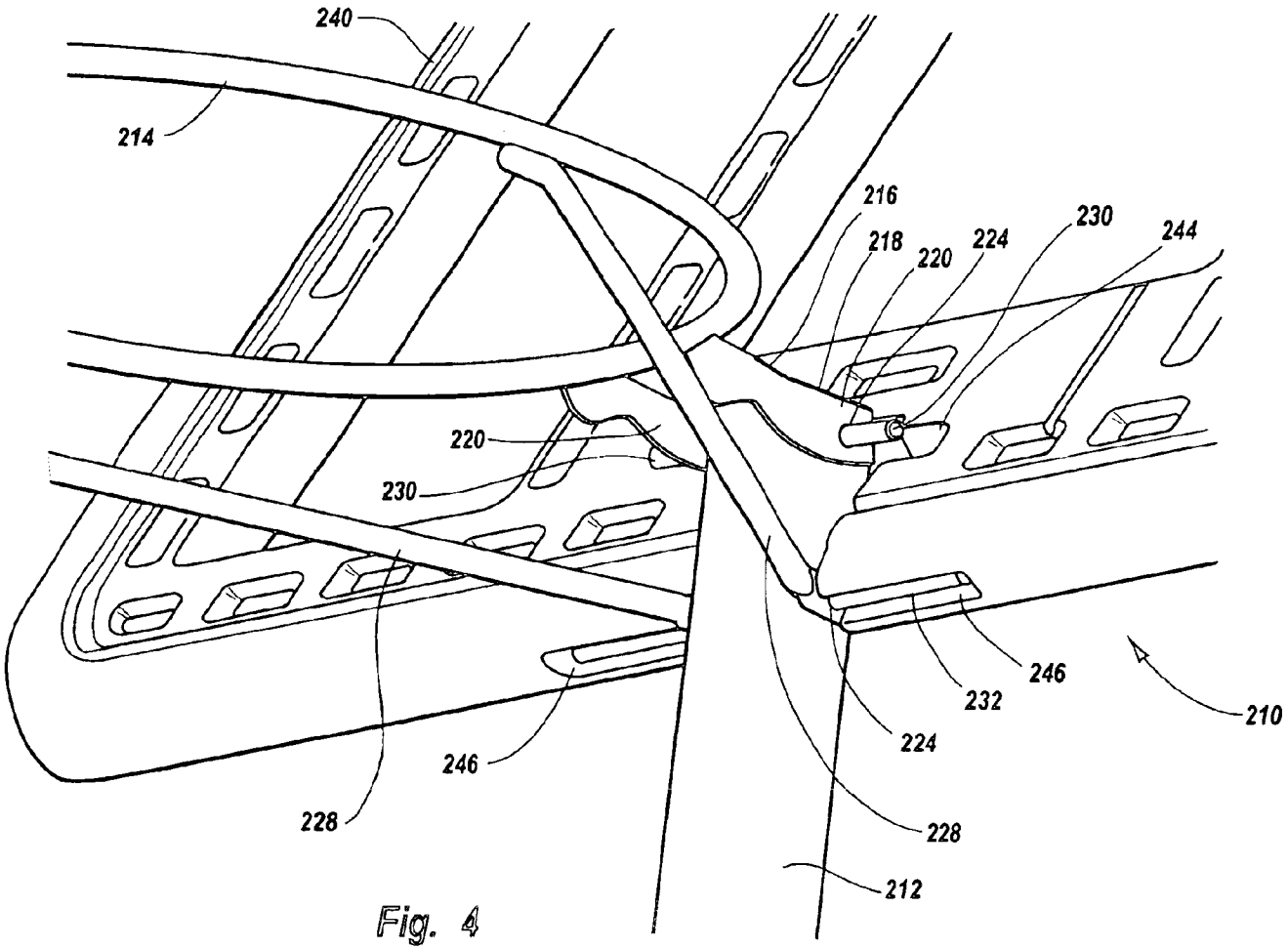
FIG. 4 is a perspective view of a portion of a basketball goal system in accordance with still another preferred embodiment of the invention, illustrating a portion of the support pole, rim, bracket and backboard.

Another suitable configuration for the basketball goal system 210 is shown in FIG. 4. The basketball goal system 210 includes a support pole 212, a rim 214 and a bracket 216. The bracket 216 includes a rim plate 218 with a generally horizontal upper surface and two downwardly extending flanges that form the mounting portion 220. The flanges are preferably sized and configured to contact the outer surface of the support pole 212. The upper surface of the rim plate 218 may be sized and configured to cover all or a portion of the upper portion of the support pole 212. The bracket 216, however, does not require the rim plate 218 and the bracket could simply include the two downwardly extending flanges of the mounting portion 220. The two downwardly extending flanges each include an opening 224 that is configured to be aligned with corresponding openings 226 in the support pole 212, and these openings are sized and configured to receive an upper support pin 230. If desired, one or more sleeves may be attached to the downwardly extending flanges of the mounting portion 220.

The basketball goal system 210 also includes a pair of support members 228 that include a first end that is connected to the rim 214 and a second end with an opening 224 that is configured to be aligned with corresponding openings 226 in the support pole 212. This allows the lower support pin 232 to be inserted through the openings 224 and 226 to attach the rim 214 to the support pole 212. As shown in FIG. 4, the second ends of the support members 228 are not connected to the rim plate 218 or the downwardly extending flanges. One skilled in the art, however, will appreciate that the second ends of the support members 228 could be attached to the rim plate 218 or the downwardly extending flanges.

As shown in FIG. 4, the backboard 240 includes an upper groove 244 and a lower groove 246 that are sized and configured to receive the upper support pin 230 and the lower support pin 232, respectively. Preferably, the lower support pin 232 is first inserted into the lower groove 246 while the backboard 240 is located at an angle relative to the rim 214. The backboard 240 is then pivoted towards a vertical position wherein the upper support pin 230 is inserted into the upper groove 244. The backboard 240 is preferably securely attached to the support pins 230, 232 as discussed above.

The basketball goal system 210 shown in FIG. 4 does not include a brace 34 as shown in FIGS. 1 and 2, or a brace 134 as shown in FIG. 3. Thus, the basketball goal system 210 can be constructed without a brace. It will be understood, however, that the basketball goal system 210 may include a brace if desired. Additionally, as shown in FIG. 4, the upper groove 244 is disposed in the front surface of the backboard 240, e.g., the surface of the backboard that is disposed towards the rim 214. It will be understood that the grooves 244, 246 may be positioned in any. suitable portion of the backboard 240.

Advantageously, the basketball goal system 10 can be quickly and easily assembled by the manufacturer or consumer. In order to assemble the basketball goal system 10, which is shown in FIGS. 1 and 2, the mounting portion 20 of the bracket 16 is positioned such that the upper pair of sleeves 24 are aligned with the upper pair of openings in the support pole 12, and the lower pair of sleeves are aligned with the lower pair of openings in the support pole. The upper support pin 30 and lower support pin 32 can then be partially inserted through one of the respective sleeves 24 and into a corresponding opening 26 in the support pole 12, if desired, to provide a temporary connection of the rim 14 to the support pole 12.

The brace 34 is then inserted into the opening in the upper portion of the support pole 12 and the openings 36 in the brace are aligned with the openings 26 in the support pole and sleeves 24. The upper and lower support pins 30, 32 can then be inserted through the openings 36 in the brace 34 and the corresponding opposing openings 26 in the support pole 12 and sleeves 24. On the other hand, the mounting portion 20 of the bracket 16 may be positioned so that the sleeves 24 are aligned with the openings 26 in the support pole 12 and the openings 36 in the brace 34, and then the upper and lower support pins 30, 32 may be used to attach the rim 14 and brace to the support pole. One skilled in the art will appreciate that the brace 34 could also first be inserted into the upper end of the support pole 12 and then the bracket 16 can be positioned to allow the pins 30, 32 to attach the rim 14 to the support pole.

Once the bracket 16 and brace 34 are attached to the support pole 12, the backboard 40 is then connected to the basketball goal system 10. For example, as shown in FIG. 2, the backboard 40 may be initially positioned above the rim 14 with the rear surface of the backboard disposed towards the support pole 12. The backboard 40 is then moved such that the rim plate 18 of the brace 16 is inserted into the cutout 50 in the backboard until the lower support pin 32 is inserted into the lower groove 46. The backboard 40 is then moved such that the upper support pin 30 is inserted into the upper groove 44 and the brace 34 is inserted into the brace groove 48. The backboard 40 may also be positioned and configured such that the lower support pin 32 is inserted into the lower groove 46, the upper support pin 30 is inserted into the upper groove 44 and the brace 34 is inserted into the brace groove 48 simultaneously. One skilled in the art will appreciate that these components may be connected in any suitable order depending, for example, upon the arrangement of these various components. The backboard 40 is preferably securely connected to the support pins 30, 32 and/or brace 34 by a snap fit or interference connection, but it will be appreciated that the backboard may be connected to the support pole 12 in any suitable manner.

In order to disassemble the basketball goal system 10, the backboard 40 may be pivoted or moved such that the brace 34 is removed from the brace groove 48, the upper support pin 30 is removed from the upper groove 44, and the lower support pin 32 is removed from the lower groove 46. The support pins 30, 32 can then be removed from the sleeves 24 in the bracket, the openings 26 in the support pole 12, and the openings 36 in the brace 34. This allows the brace 34 and rim 14 to be disconnected from the support pole 12. Thus, the basketball goal system 10 can be quickly and easily assembled and/or disassembled. One skilled in the art will understand that the basketball goal systems 110 and 210 can preferably be assembled and/or disassembled in a similar manner.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A basketball goal system comprising:

an elongated support pole that is sized and configured to support a basketball goal above a surface, the elongated support pole including a first set of openings and a second set of openings;

a rim;

a unitary one piece bracket directly connecting and extending between the rim and the support pole, the bracket including a first portion that is connected to the rim and a mounting portion that is connected to the support pole, the bracket including a first set of openings and a second set of openings;

a first pin that is sized and configured to be inserted through the first set of openings in the support pole and the first set of openings in the bracket to attach the bracket to the support pole; and a second pin that is sized and configured to be inserted through the second set of openings in the support pole and the second set of openings in the bracket to attach the bracket to the support pole.

2. The basketball goal system as in claim 1, further comprising a backboard including a first groove that is sized and configured to receive at least a portion of the first pin and a second groove that is sized and configured to receive at least a portion of the second pin when the backboard is connected to the support pole.

3. The basketball goal system as in claim 2, wherein the first pin is attached to the first groove by a snap-fit attachment and the second pin is attached to the second groove by a snap-fit attachment.

4. The basketball goal system as in claim 2, wherein the first pin is attached to the first groove by an interference fit and the second pin is attached to the second groove by an interference fit.

5. The basketball goal system as in claim 1, further comprising a backboard constructed from blow-molded plastic, the backboard including a first groove and a second groove that are integrally formed in the backboard during the blow-molding process, the first groove being sized and configured to receive at least a portion of the first pin and the second groove being sized and configured to receive at least a portion of the second pin.

6. The basketball goal system as in claim 5, further comprising a plurality of depressions formed in the backboard, the depressions being sized and configured to increase the strength of the backboard.

7. The basketball goal system as in claim 1, further comprising a first set of sleeves that are generally aligned with the first set of openings in the bracket and a second set of sleeves that are generally aligned with the second set of openings in the bracket.

8. The basketball goal system as in claim 1, further comprising a brace that is sized and configured to be attached to the support pole, the brace including a first set of openings and a second set of openings; wherein the first pin is sized and configured to be inserted through the first set of openings in the support pole and the first set of openings in brace to attach the brace to the support pole; and wherein the second pin is sized and configured to be inserted through the second set of openings in the support pole and the second set of openings in brace to attach the brace to the support pole.

9. The basketball goal system as in claim 8, further comprising a backboard including a brace groove, the brace groove being sized and configured to receive at least a portion of the brace.

10. The basketball goal system as in claim 8, further comprising a backboard constructed from blow-molded plastic, the backboard including brace groove that is integrally formed in the backboard during the blow-molding process.

11. The basketball goal system as in claim 10, further comprising a plurality of depressions formed in the backboard, the depressions being sized and configured to increase the strength of the backboard.

12. A basketball goal system comprising:

a support member including a first set of openings;

a rim;

a bracket that is sized and configured to attach the rim to the support member, the bracket including a first set of openings;

a brace including a first set of openings;

a first support pin that is sized and configured to be inserted through the first set of openings in the support member, the first set of openings in the bracket and the first set of openings in the brace to connect the bracket and brace to the support member; and a backboard including a first groove and a brace groove, at least a portion of the first support pin being sized and configured to be inserted into the first groove and at least a portion of the brace being sized and configured to be inserted into the brace groove when the backboard is attached to the support member.

13. The basketball goal system as in claim 12, further comprising a second set of openings in the support member, a second set of openings in the bracket, a second set of openings in the brace, and a second support pin; wherein the second support pin is sized and configured to be inserted through the second set of openings in the support member, the second set of openings in the bracket and the second set of openings in the brace to connect the bracket and brace to the support member.

14. The basketball goal system as in claim 13, further comprising a second groove in the backboard, at least a portion of the second support pin being sized and configured to be inserted into the second groove when the backboard is attached to the support member.

15. The basketball goal system as in claim 13, further comprising a first set of sleeves that are generally aligned with the first set of openings in the bracket and a second set of sleeves that are generally aligned with the second set of openings in the bracket.

16. The basketball goal system as in claim 12, further comprising a plurality of depressions formed in the backboard, the depressions being sized and configured to increase the strength of the backboard.

17. A basketball goal system comprising:

a support member including a first set of openings;

a brace including a first set of openings, the brace being sized and configured such that the first set of openings in the support member can be generally aligned with the first set of openings in the brace;

a first pin that is sized and configured to be inserted through the first set of openings in the support member and the first set of openings in the brace to connect the brace to the support member; and a backboard including a brace groove and a first groove;

wherein the brace is received within the brace groove and the first pin is received within the first groove when the backboard is connected to the support member.

18. The basketball goal system as in claim 17, further comprising a second set of openings in the support member, a second set of openings in the brace, the brace being sized and configured such that the second set of openings in the support member can be generally aligned with the second set of openings in the brace; and further comprising a second pin that is sized and configured to be inserted through the second set of openings in the support member and the second set of openings in the brace to connect the brace to the support member.

19. The basketball goal system as in claim 18, further comprising a second groove in the backboard; wherein the second pin is received within the second groove when the backboard is connected to the support member.

20. The basketball goal system as in claim 18, further comprising a rim and a bracket that is sized and configured to attach the rim to the support member, the bracket including a first portion that is connected to the rim and a mounting portion that is sized and configured to be connected to the support member, the bracket including a first set of openings and the first pin being sized and configured to be inserted through the first set of openings in the bracket to connect the rim to the support member.

21. The basketball goal system as in claim 20, further comprising a second set of openings in the bracket, a second set of openings in the support member, a second set of openings in the brace; and further comprising a second pin that is sized and configured to be inserted through the second set of openings in the bracket, the second set of openings in the support member and the second set of openings in the brace.

22. A basketball goal system comprising:

an elongated support pole that is sized and configured to support a basketball goal above a surface, the elongated support including a first set of openings and a second set of openings;

a bracket including a first portion that is connected to the rim and a second portion that is connected to the elongated support pole, the bracket including a first set of openings and a second set of openings;

a first elongated connector that extends through the first set of openings in the elongated support pole and the first set of openings in the bracket to connect the bracket to the support pole;

a second elongated connector that extends through the second set of openings in the elongated support pole and the second set of openings in the bracket to connect the bracket to the support pole; and a backboard including a first receiving portion that is sized and configured to receive at least a portion of the first elongated connector and a second receiving portion that is sized and configured to receive at least a portion of the second elongated connector to connect the backboard to the bracket and the elongated support pole.

23. The basketball goal system as in claim 22, wherein the backboard is constructed from blow-molded plastic; and wherein the first receiving portion and the second receiving portion are integrally formed in the backboard during the blow-molding process.

24. The basketball goal system as in claim 22, further comprising a first set of sleeves that are generally aligned with the first set of openings in the bracket and a second set of sleeves that are generally aligned with the second set of openings in the bracket.

25. The basketball goal system as in claim 22, wherein an upper end of the elongated support pole and an upper surface of the rim are generally aligned in the same plane.

26. The basketball goal system as in claim 22, wherein the second portion of the bracket includes a radius of curvature that is generally equal to or greater than a radius of curvature of an outer surface of the elongated support pole.

27. The basketball goal system as in claim 22, further comprising a brace that is connected to the elongated support pole, the brace including a first set of openings and a second set of openings, the first elongated connector being inserted through the first set of openings in the support pole and the first set of openings in brace to connect the brace to the support pole, the second elongated connector being inserted through the second set of openings in the support pole and the second set of openings in brace to connect the brace to the support pole.

28. The basketball goal system as in claim 27, further comprising a brace groove in the backboard that receives at least a portion of the brace.

* * * * *

UNITED STATES PATENT AND TRADEMARK OFFICE

CERTIFICATE OF CORRECTION

PATENT NO. : 6,881,162 B2
DATED : April 19, 2005
INVENTOR(S) : Nye et al.

It is certified that error appears in the above-identified patent and that said Letters Patent is hereby corrected as shown below:

Column 1,
Line 43, change “is assembly” to -- assembles --

Column 4,
Line 31, change “limits” to -- limit --

Column 8,
Line 26, change “12 pole” to -- pole 12 --
Line 53, change “then” to -- than --

Column 9,
Line 30, change “pole 14” to -- pole 12 --

Column 10,
Lines 5 and 22, remove “14”
Line 31, change “52 on” to -- 52 in --
Line 53, change “10,352,940” to -- 10/352,940 --

Column 15,
Line 40, change “connected to the” to -- connected to a --

Signed and Sealed this

Twelfth Day of July, 2005

JON W. DUDAS
*Director of the United States Patent and Trademark Office*